US007546739B2

(12) United States Patent
Holland et al.

(10) Patent No.: US 7,546,739 B2
(45) Date of Patent: Jun. 16, 2009

(54) IGNITER TUBE AND METHOD OF ASSEMBLING SAME

(75) Inventors: Thomas George Holland, Dayton, OH (US); Steven Clayton Vise, Loveland, OH (US); Marie Ann McMasters, Mason, OH (US)

(73) Assignee: General Electric Company, Schenectady, NY (US)

( * ) Notice: Subject to any disclaimer, the term of this patent is extended or adjusted under 35 U.S.C. 154(b) by 443 days.

(21) Appl. No.: 11/174,746

(22) Filed: Jul. 5, 2005

(65) Prior Publication Data

US 2007/0051110 A1 Mar. 8, 2007

(51) Int. Cl.
*F02C 7/26* (2006.01)
*F02C 7/264* (2006.01)

(52) U.S. Cl. ..... 60/772; 60/39.821; 60/39.827; 60/39.83

(58) Field of Classification Search ..... 60/39.821, 60/39.827, 39.83, 772
See application file for complete search history.

(56) References Cited

U.S. PATENT DOCUMENTS 3,048,015 A * 8/1962 Barrelle et al. ..... 60/39.821
3,572,733 A * 3/1971 Howald et al. ..... 277/411
5,241,827 A * 9/1993 Lampes ..... 60/754
6,351,949 B1 * 3/2002 Rice et al. ..... 60/752
6,468,033 B1 10/2002 Weidlich
6,557,350 B2 5/2003 Farmer et al.
6,715,279 B2 * 4/2004 White ..... 60/39.821
6,856,666 B2 2/2005 Lonn et al.
7,013,634 B2 * 3/2006 Pidcock et al. ..... 60/39.821
7,216,488 B2 * 5/2007 Howell et al. ..... 60/39.821

FOREIGN PATENT DOCUMENTS

EP 1424469 A2 * 11/2003

* cited by examiner

*Primary Examiner*—Ted Kim
(74) *Attorney, Agent, or Firm*—William Scott Andes, Esq.; Armstrong Teasdale LLP

(57) ABSTRACT

An igniter tube assembly includes an axis of symmetry extending therethrough, an igniter tube that includes a first opening extending coaxially therethrough having a diameter sized to receive a portion of the igniter therethrough such that the igniter tube circumscribes the igniter and such that a gap is defined between the igniter tube and the igniter, a ferrule coupled to the igniter tube, and a plurality of cooling air openings extending through at least one of the igniter tube and the ferrule to facilitate channeling cooling air into the gap.

20 Claims, 5 Drawing Sheets

IGNITER TUBE AND METHOD OF ASSEMBLING SAME

BACKGROUND OF THE INVENTION

This invention relates generally to gas turbine engines, and more specifically to igniter tubes used with gas turbine engine combustors.

Combustors are used to ignite fuel and air mixtures in gas turbine engines. Known combustors include at least one dome attached to a combustor liner that defines a combustion zone. More specifically, the combustor liner includes an inner and an outer liner that extend from the dome to a turbine nozzle. The liner is spaced radially inwardly from a combustor casing such that an inner and an outer passageway are defined between the respective inner and outer liner and the combustor casing.

At least some known gas turbine engines include an igniter tube that facilitates maintaining the igniter in alignment within the combustor. More specifically, the igniter extends through the igniter tube such that the igniter is maintained in alignment relative to the combustion chamber.

During operation, high pressure airflow is discharged from the compressor into the combustor where the airflow is mixed with fuel and ignited utilizing the igniters. Moreover, a portion of the airflow entering the combustor is channeled through the combustor outer passageway for cooling the outer liner, the igniters, and to facilitate diluting a main combustion zone within the combustion chamber. Because the igniters are bluff bodies, the airflow may separate and wakes may develop downstream from each igniter. As a result, a downstream side of the igniters and their respective igniter tubes are not as effectively cooled as an upstream side of the igniters and their respective igniter tubes which are each cooled using airflow that has not separated. Furthermore, as a result of the wakes generated by the igniters, circumferential temperature gradients may develop in the igniter tubes. Additionally, hot gases ingested into the igniter tube may result in relatively high temperatures, and temperature gradients, and/or stresses. Over time, continued operation with increased temperature gradients may induce potentially damaging thermal stresses into the combustor that exceed an ultimate strength of materials used in fabricating the igniter tubes. As a result, thermally induced transient and steady state stresses may cause low cycle fatigue (LCF) failure of the igniter tubes.

Because igniter tube replacement is a costly and time-consuming process, at least some known combustors increase a gap between the igniters and the igniter tubes to facilitate reducing thermal circumferential stresses induced within the igniter tubes. As a result of the gap, leakage passes from the passageways to the combustion chamber to provide a cooling effect for the igniter tubes adjacent the combustor liner. However, because such air is used in the combustion process, such gaps provide only intermittent cooling, and the igniter tubes may still require replacement.

BRIEF SUMMARY OF THE INVENTION

In a first aspect, a method for assembling a gas turbine engine igniter tube assembly is provided. The gas turbine engine includes a combustor, and at least one igniter inserted at least partially into the combustor. The method includes providing an igniter tube as assembly including an axis of symmetry extending therethrough, an igniter tube, and a ferrule, the igniter tube having a first opening extending coaxially therethrough having a diameter sized to receive a portion of the igniter therethrough such that the igniter tube circumscribes the igniter and such that a gap is defined between the igniter tube and the igniter, and a plurality of cooling air openings extending through at least one of the igniter tube and the ferrule to facilitate channeling cooling air into the gap, and coupling the igniter tube and the ferrule to the combustor.

In another aspect, an igniter tube assembly for a gas turbine engine is provided. The gas turbine engine includes a combustor, and at least one igniter inserted at least partially into the combustor. The igniter tube assembly includes an axis of symmetry extending therethrough, an igniter tube that includes a first opening extending coaxially therethrough having a diameter sized to receive a portion of the igniter therethrough such that the igniter tube circumscribes the igniter and such that a gap is defined between the igniter tube and the igniter, a ferrule coupled to the igniter tube, and a plurality of cooling air openings extending through at least one of the igniter tube and the ferrule to facilitate channeling cooling air into the gap.

In a further aspect, a gas turbine engine is provided. The gas turbine engine includes a combustor that includes an annular outer liner and an annular inner liner that define a combustion chamber therebetween, and at least one igniter tube assembly coupled to the combustor. The igniter tube assembly includes an axis of symmetry extending therethrough, an igniter tube that includes a first opening extending coaxially therethrough having a diameter sized to receive a portion of the igniter therethrough such that the igniter tube circumscribes the igniter and such that a gap is defined between the igniter tube and the igniter, a ferrule coupled to the igniter tube, and a plurality of cooling air openings extending through at least one of the igniter tube and the ferrule to facilitate channeling cooling air into the gap.

DETAILED DESCRIPTION OF THE INVENTION

Figure 1:
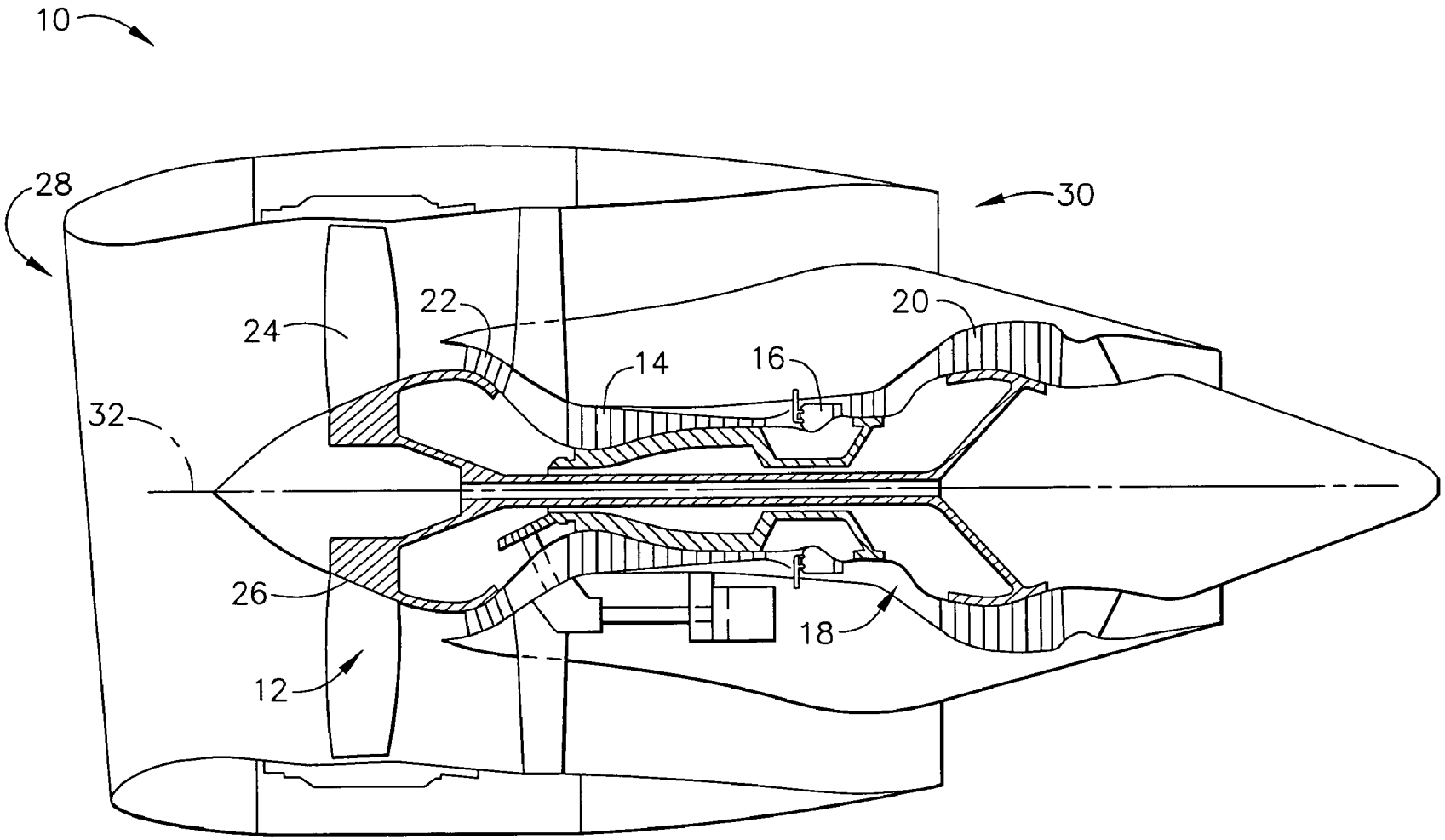
FIG. 1 is a schematic illustration of a gas turbine engine including a combustor.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, gas turbine engine 10 is a GE90 engine commercially available from General Electric Company, Cincinnati, Ohio.

In operation, air flows along an engine rotation axis 32 through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
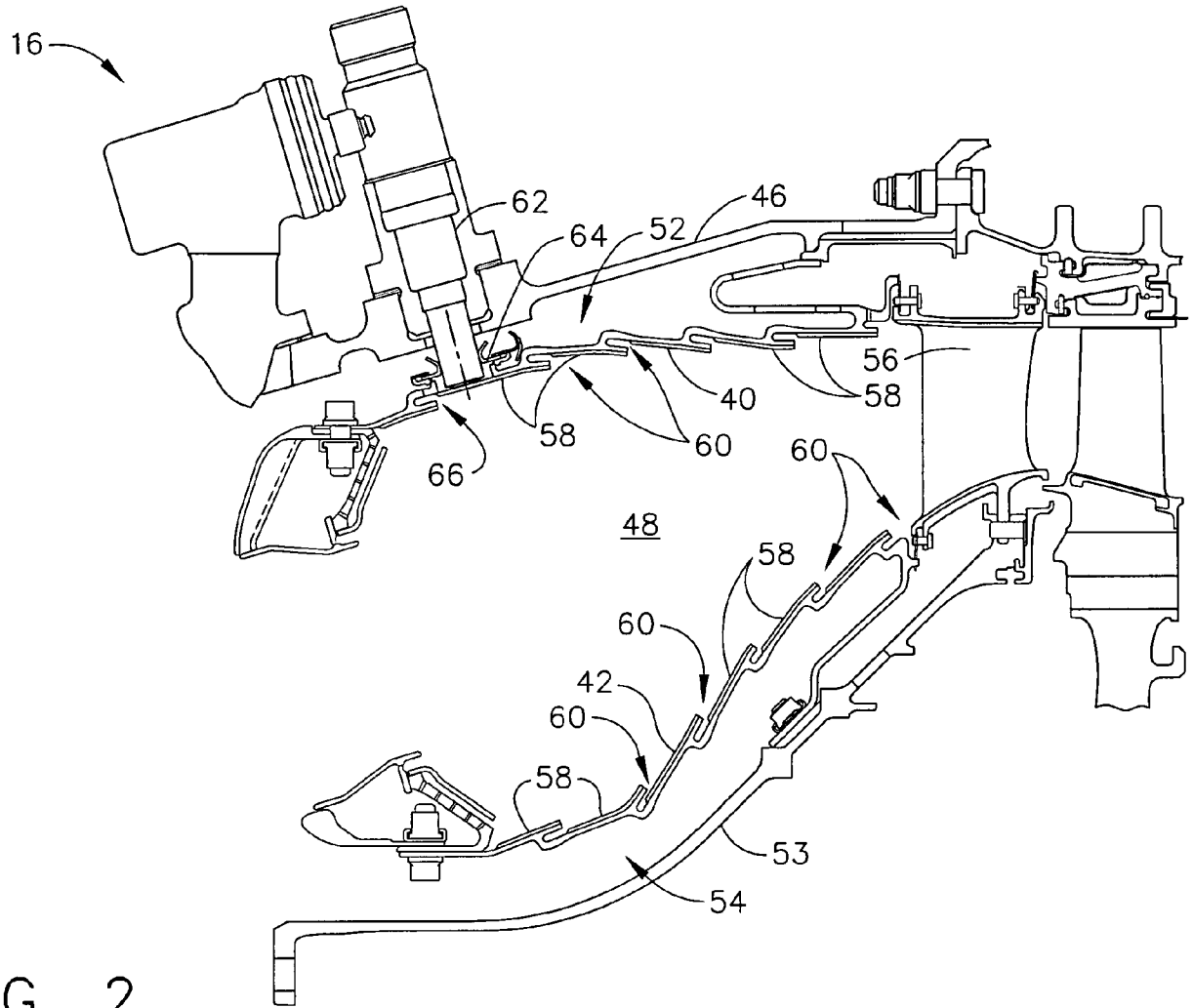
FIG. 2 is a cross-sectional view of a combustor that may be used with the gas turbine engine shown in FIG. 1.

FIG. 2 is a cross-sectional view of combustor 16 used in gas turbine engine 10. Combustor 16 includes an annular outer liner 40, an annular inner liner 42, and a domed end (not shown) that extends between outer and inner liners 40 and 42, respectively. Outer liner 40 and inner liner 42 are spaced inward from a combustor casing 46 and define a combustion chamber 48. Outer liner 40 and combustor casing 46 define an outer passageway 52, and inner liner 42 and a forward inner nozzle support 53 define an inner passageway 54.

Combustion chamber 48 is generally annular in shape and is disposed between liners 40 and 42. Outer and inner liners 40 and 42 extend from the domed end, to a turbine nozzle 56 disposed downstream from the combustor domed end. In the exemplary embodiment, outer and inner liners 40 and 42 each include a plurality of panels 58 which include a series of steps 60, each of which forms a distinct portion of combustor liners 40 and 42.

A plurality of fuel igniters 62 extend through combustor casing 46 and outer passageway 52, and couple to combustor outer liner 40. In one embodiment, two fuel igniters 62 extend through combustor casing 46. Igniters 62 are bluff bodies that are placed circumferentially around combustor 16 and are downstream from the combustor domed end. Each igniter 62 is positioned to ignite a fuel/air mixture within combustion chamber 48, and each includes an igniter tube assembly 64 coupled to combustor outer liner 40. More specifically, each igniter tube assembly 64 is coupled within an opening 66 extending through combustor outer liner 40, such that each igniter tube assembly 64 is concentrically aligned with respect to each opening 66. Igniter tube assemblies 64 maintain alignment of each respective igniter 62 relative to combustor 16. In one embodiment, combustor outer liner opening 66 has a substantially circular cross-sectional profile.

During engine operation, airflow (not shown) exits high pressure compressor 14 (shown in FIG. 1) at a relatively high velocity and is directed into combustor 16 where the airflow is mixed with fuel and the fuel/air mixture is ignited for combustion using igniters 62. As the airflow enters combustor 16, a portion (not shown in FIG. 2) of the airflow is channeled through combustor outer passageway 52. Because each igniter 62 is a bluff body, as the airflow contacts igniters 62, a wake develops in the airflow downstream each igniter 62.

Figure 3:
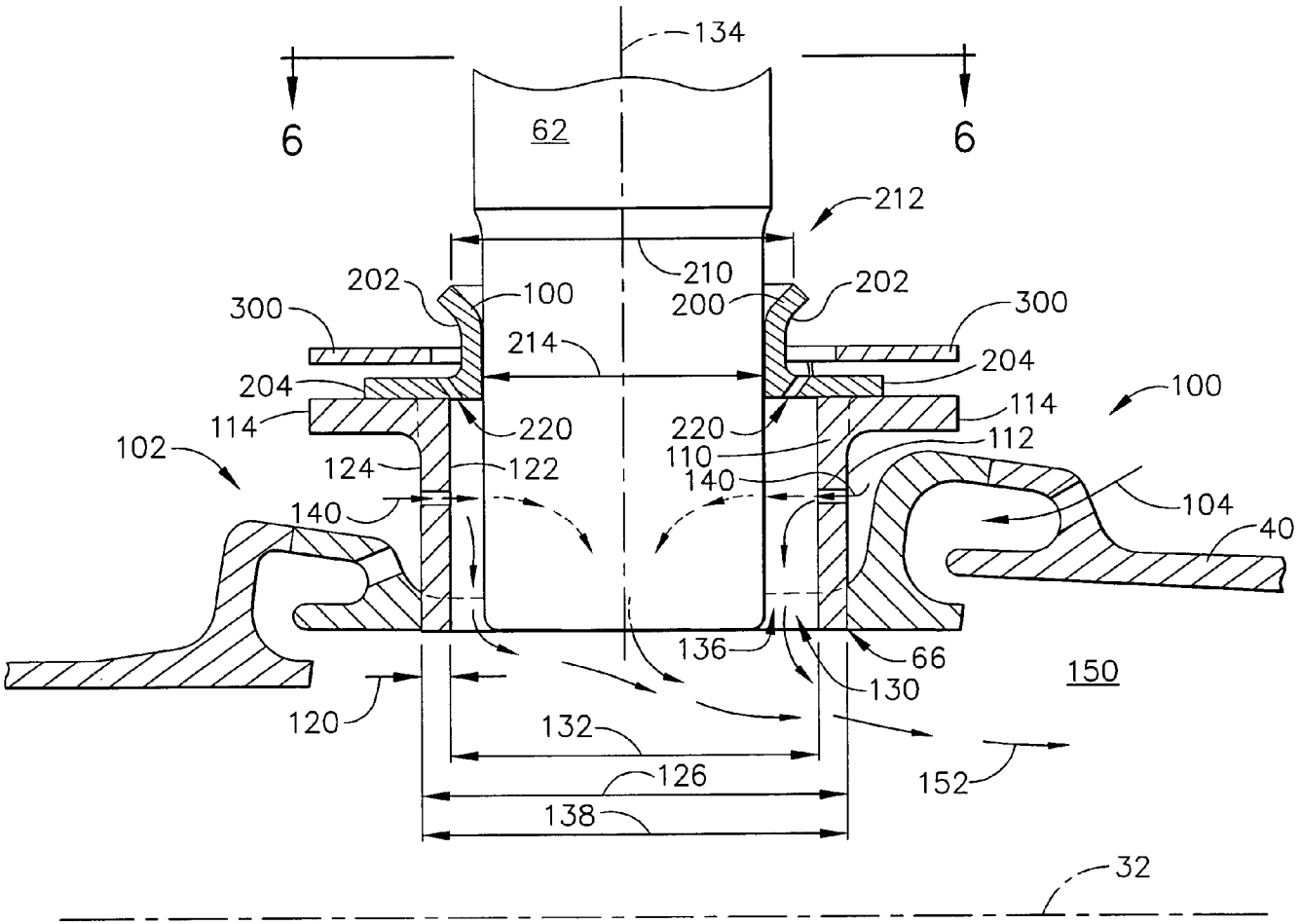
FIG. 3 is an enlarged cross-sectional view of an igniter tube assembly.
Figure 4:
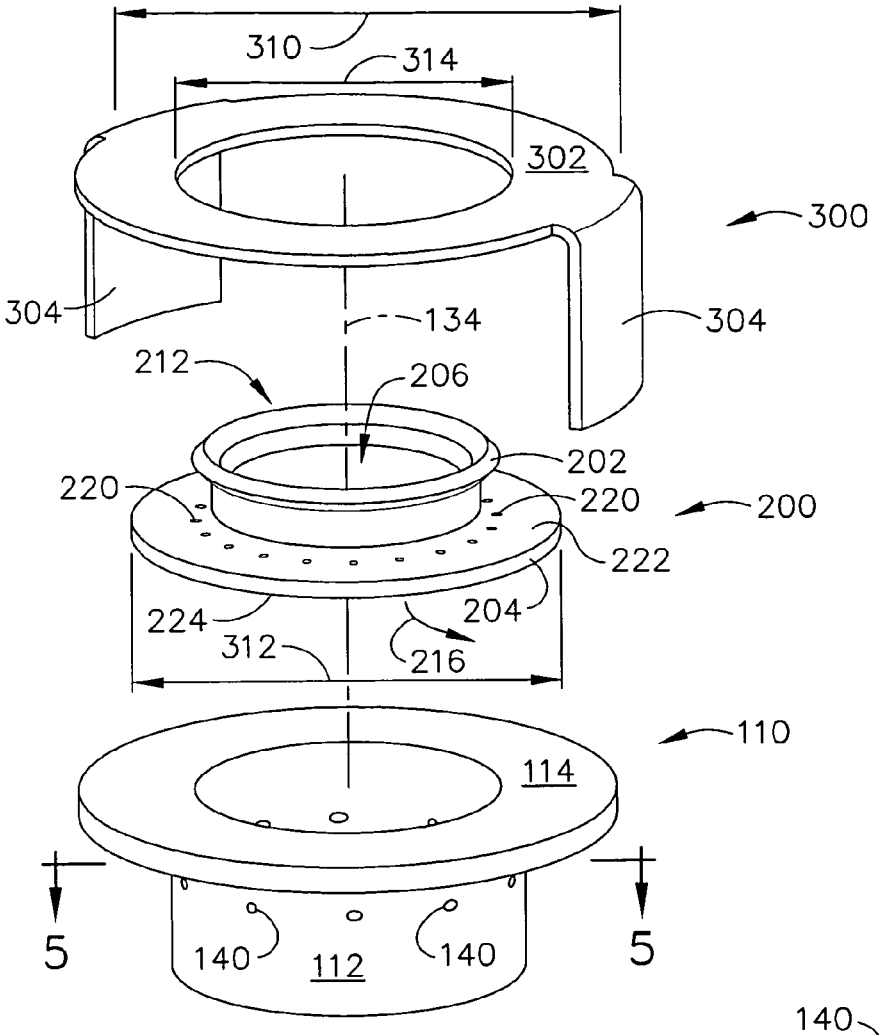
FIG. 4 is an exploded view of the igniter tube assembly shown in FIG. 3.
Figure 5:
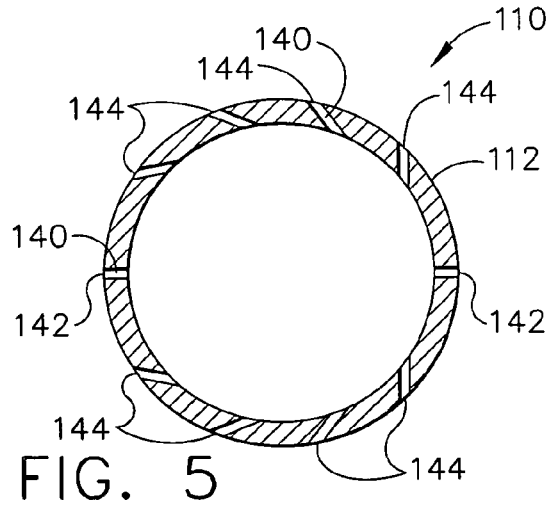
FIG. 5 is a top view of a portion of the igniter tube assembly shown in FIG. 3.

FIG. 3 is an enlarged cross-sectional view of an igniter tube assembly 100 that is coupled to combustor outer liner 40 and can be used with gas turbine engine 10 (shown in FIG. 1). FIG. 4 is an exploded view of igniter tube assembly 100. FIG. 5 is a top cross-sectional view of a portion of igniter tube assembly 100 taken through 5-5. Igniter tube assembly 100 has an upstream side 102, and a downstream side 104. In the exemplary embodiment, each igniter tube assembly 100 includes an igniter tube 110 that includes a body portion 112 and a flange portion 114 that is coupled to body portion 112. In the exemplary embodiment, body portion 112 and flange portion 114 are formed unitarily such that igniter tube 110 has a substantially L-shaped cross-sectional profile. In an alternative embodiment, body portion 112 and flange portion 114 are formed as separate components and coupled together using a welding or brazing procedure, for example to form igniter tube 110.

In the exemplary embodiment, body portion 112 includes a thickness 120 that extends between a body portion inner surface 122 and a body portion outer surface 124. Body portion 112 has an outer diameter 126 that is sized such that body portion 112 can be inserted at least partially through combustor outer liner opening 66. Body portion 112 also includes an opening 130 having a diameter 132. In the exemplary embodiment, opening 130 extends through body portion 112 along an axis of symmetry 134 that is substantially normal to engine operational axis 32. In one embodiment, opening 130 is substantially circular and is sized to receive igniter 62, and to facilitate forming a cavity or gap 136 between body portion inner surface 122 and igniter 62. Accordingly, cavity 136 formed between inner surface 122 and igniter 62, approximately circumscribes igniter 62. Body portion outer diameter 126 is approximately equal to an inner diameter 138 of combustor outer liner opening 66, and accordingly, igniter tube body portion 112 is received in close tolerance within combustor outer liner opening 66. In the exemplary embodiment, body portion inner surface 122 has a substantially circular outer perimeter.

In the exemplary embodiment, body portion 112 also includes a plurality of openings 140 that extend from inner surface 122 to outer surface 124 such that airflow (not shown) can be channeled from upstream side 102 through openings 140 into cavity 136. The air is then channeled from cavity 136 into the hot side of combustor 16 and down the hot flow path, i.e. downstream side 152. In the exemplary embodiment, openings 140 substantially circumscribe body portion 112 and are formed through body portion 112 such that the airflow channeled through openings 140 flows approximately parallel to engine operational axis 32.

More specifically, body portion 112 openings 140 include a plurality of both angled and non-angled openings 142 and 144 that facilitate allowing cooling air to enter igniter tube 110, and thus cool the hot surfaces, and then purge the relatively hot gases within cavity 136. For example, in the exemplary embodiment, at least a portion of openings 140 can be formed straight through body portion 112 and/or formed at a compound angle through body portion 112. Moreover, openings 140 can be formed in a homogenous pattern around a periphery of body portion 112, i.e. spaced approximately uniformly around body portion 112, and/or in a preferential pattern, i.e. space non-homogenously around body portion 112 depending on the needs of the components and ignition requirements.

Accordingly, during operation airflow is channeled from upstream side 102, through openings 140 to facilitate reducing and/or eliminating hot gas recirculation zones within cavity 136. The hot gases within cavity 136 are then discharged into the hot side 150 of combustor 16 and down the hot flow path 152.

In the exemplary embodiment, igniter tube assembly 100 also includes a ferrule 200. In the exemplary embodiment, ferrule 200 is attached to igniter tube 110 and includes a receiving ring 202 and an attaching ring 204. Attaching ring 204 is annular and extends from flange portion 114 such that attaching ring 204 is substantially parallel to flange portion 114. Receiving ring 202 extends radially outwardly from attaching ring 204. More specifically, receiving ring 202 extends divergently from attaching ring 204, such that an opening 206 extending through ferrule 200 has a diameter 210 at an entrance 212 of ferrule 200 that is larger than a diameter 214 at an exit 216 of ferrule 200. Accordingly, ferrule entrance 212 facilitates guiding igniter 62 into igniter tube 110, and ferrule exit 214 maintains igniters 62 in alignment relative to combustor 16 (shown in FIGS. 1 and 2). In the exemplary embodiment, receiving ring 202 and an attaching ring 204 are formed together unitarily.

In the exemplary embodiment, ferrule 200 also includes a plurality of openings 220 that extend from a radially outer surface 222, through attaching ring 204, to a radially inner surface 224 of attaching ring 204. Accordingly, openings 220 extend through attaching ring 204 to facilitate the airflow being channeled through attaching ring openings 220 and into cavity 136. In the exemplary embodiment, openings 220 are formed at an angle that is tangential or perpendicular to axis 134 to facilitate channeling cooling air into cavity 136.

In one embodiment, at least a portion of openings 220 can be formed straight through ferrule 200, i.e. approximately parallel with axis 134, and/or formed at a compound angle through ferrule 200. Moreover, openings 220 can be formed in a homogenous pattern around a periphery of ferrule 200, i.e. spaced approximately uniformly around ferrule 200, and/or in a preferential pattern, i.e. space non-homogenously around ferrule 200 depending on the needs of the components and ignition requirements.

More specifically, during operation, airflow is channeled from upstream side 102, through openings 220 and into cavity 136 to facilitate reducing and/or eliminating hot gas recirculation zones within cavity 136. In the exemplary embodiment, the hot gases within cavity 136 are then discharged into the hot side 150 of combustor 16 and down the hot flow path 152.

In one embodiment, ferrule 200 is frictionally coupled to igniter tube 110 such that ferrule 200 "floats" on igniter tube 110. More specifically, igniter 62 floats radially in ferrule 200 and ferrule 200 floats on top of igniter tube 110 to allow for differences in thermal growth. In an alternative embodiment ferrule 200 is coupled to igniter tube 110 using a retainer 300 (shown in FIG. 4).

Figure 6:
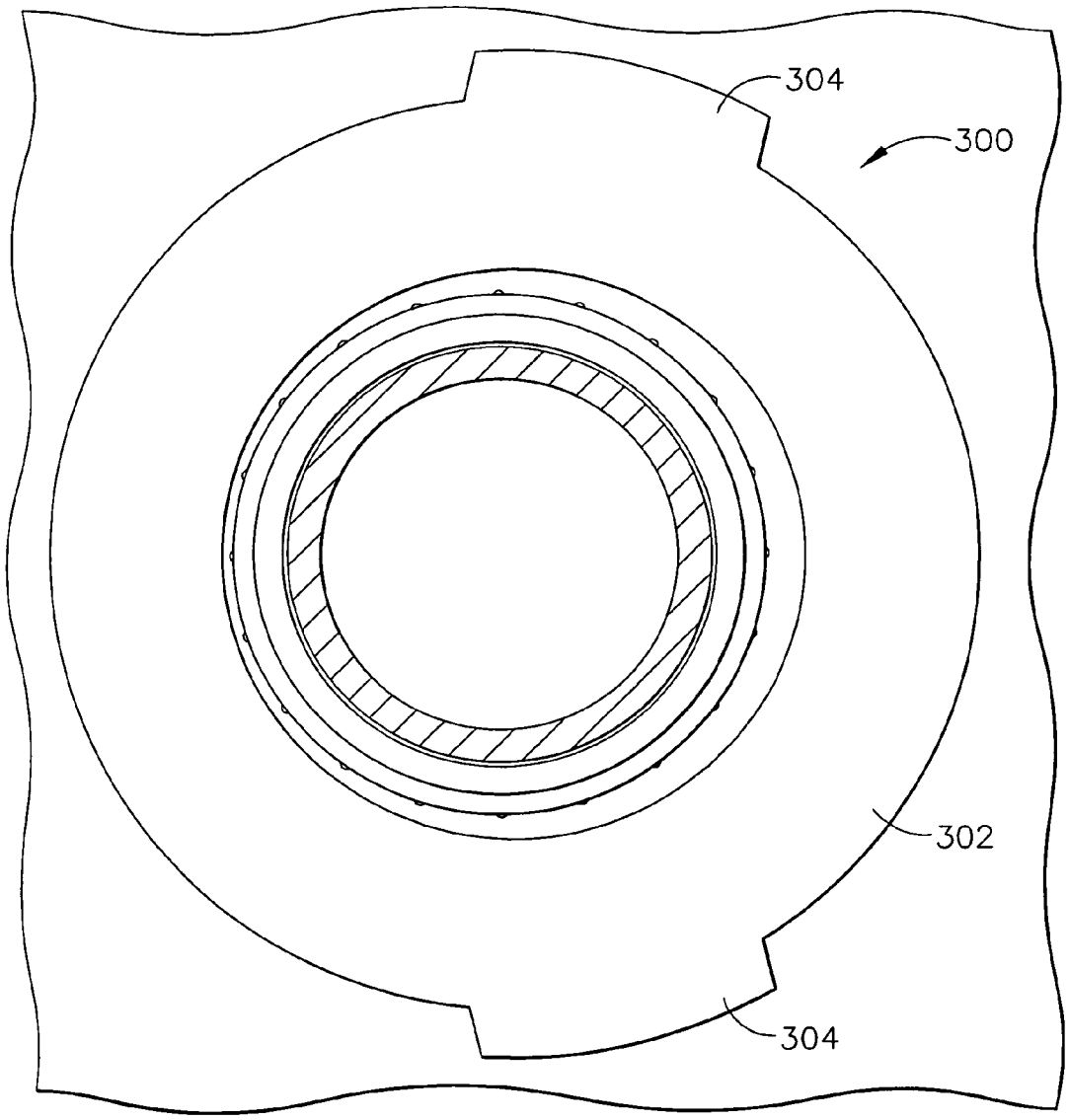
FIG. 6 is a top cross-sectional view of a portion of the igniter tube assembly shown in FIG. 3.

FIG. 6 is a top view of retainer 300 (shown in FIG. 4). In the exemplary embodiment, retainer 300 includes a body portion 302 and a plurality of tabs 304 that are coupled to body portion 302. In one embodiment, body portion 302 and tabs 304 are formed unitarily such that retainer 300 has a substantially U-shaped cross-sectional profile. In an alternative embodiment, body portion 302 and tabs 304 are formed as separate components and coupled together using a welding or brazing procedure, for example.

In the exemplary embodiment, body portion 302 has an outer diameter 310 that is larger than an outer diameter 312 of ferrule 200 to facilitate coupling and/or holding ferrule 200 against igniter tube 110. Moreover, body portion 302 also has an inner diameter 314 that is sized sufficiently large such that body portion 302 does not obstruct ferrule openings 220. In one embodiment, outer diameter 310 of retainer 300 and outer diameter 312 of ferrule 200 are sized and tabs 304 are positioned such that retainer 300 seats circumferentially against igniter tube 110.

In the exemplary embodiment, tabs 304 extend at an angle that is approximately normal to body portion 302 to facilitate retainer 300 to combustor outer liner 40. Accordingly, apparatus 300 approximately circumscribes ferrule 200 and igniter tube 110 to facilitate coupling ferrule 200 and igniter tube 110 to combustor outer liner 40.

Described herein is an exemplary igniter tube assembly that includes an igniter tube having a plurality of openings extending through a sidewall thereof to facilitate channeling cooling air through the igniter tube into a cavity that is formed between the igniter tube and the igniter. The openings may be either angled and/or non-angled openings extending through the side walls of the igniter tube to facilitate purging the relatively hot gases within the cavity and thus cooling both the igniter and the igniter tube assembly. In the exemplary embodiment, the igniter tube assembly may also include a ferrule that includes a plurality of openings extending through a bottom ring of the ferrule to facilitate channeling cooling air through the ferrule into a cavity that is formed between the igniter tube and the igniter. The openings may be either angled and/or non-angled openings extending through the bottom portion of the ferrule to facilitate purging the relatively hot gases within the cavity and thus cooling both the igniter and the igniter tube assembly. Either version or combination of configurations could be used depending on application requirements. The exemplary igniter tube assembly may also include a retainer to facilitate coupling both the ferrule and the igniter tube to the outer combustor liner.

Accordingly, the igniter tube assembly described herein facilitates the reduction of igniter and igniter tube distress, and reducing the time and costs associated with replacing an igniter and igniter tube. Moreover, the igniter assembly described herein utilizes cooling air that is not utilized in the combustion process, thus cooling air is provided on a relatively continual basis to facilitate cooling the igniters thus increasing the life of the igniter.

The above-described igniter tube is cost-effective and highly reliable. The igniter tubes and ferrules include a plurality of openings that channel airflow radially inwardly and circumferentially around the igniter. More specifically, the cooling air facilitates purging hot combustion gases that collect around the igniter thus reducing temperature gradients between the igniter tubes and the combustor outer liner. As a result, lower thermal stresses and improved life of the igniter tubes are facilitated in a cost-effective and reliable manner. and While the invention has been described in terms of various specific embodiments, those skilled in the art will recognize that the invention can be practiced with modification within the spirit and scope of the claims.

What is claimed is:

1. A method for assembling a gas turbine engine, the gas turbine engine including a combustor, and at least one igniter inserted at least partially into the combustor, said method comprising:

providing an igniter tube assembly including an axis of symmetry extending therethrough, an igniter tube, and a ferrule that includes a radially inner surface and a radially outer surface, the igniter tube having a first opening extending coaxially therethrough having a diameter sized to receive a portion of the igniter therethrough such that the igniter tube circumscribes the igniter and such that a gap is defined between the igniter tube and the igniter, and at least one of a first plurality of cooling air openings defined substantially by and extending through the igniter tube and a second plurality of cooling air openings axially spaced from the at least one of a first plurality of cooling air openings which are defined substantially by and extending through the ferrule to facilitate channeling cooling air into the gap, wherein at least one of the second plurality of cooling air openings extends through the ferrule from the radially inner surface to the radially outer surface; and coupling the igniter tube and the ferrule to the combustor.

2. A method in accordance with claim 1 wherein providing an igniter tube assembly further comprises providing an igniter tube that includes at least one of the first plurality of cooling air openings extending therethrough at a first angle and at least one of the first plurality of cooling air openings extending therethrough at a second angle that is different than the first angle.

3. A method in accordance with claim 2 wherein providing an igniter tube assembly further comprises providing an igniter tube that includes at least one of the first plurality of cooling air openings extending therethrough at a first compound angle and at least one of the first plurality of cooling air openings extending therethrough at a second compound angle that is different than the first compound angle.

4. A method in accordance with claim 3 further comprising coupling a retainer that is sized to seat circumferentially against the igniter tube to the combustor such that the igniter tube and the ferrule are secured to the combustor.

5. A method in accordance with claim 4 wherein the retainer includes a plurality of tabs, said method further comprising coupling the plurality of tabs to the combustor such that the igniter tube and the ferrule are secured to the combustor.

6. A method in accordance with claim 1 wherein providing an igniter tube assembly further comprises providing a ferrule that includes at least one of the second plurality of cooling air openings extending therethrough at a first angle and at least one of the second plurality of cooling air openings extending therethrough at a second angle that is different than the first angle.

7. A method in accordance with claim 6 wherein providing an igniter tube assembly further comprises providing a ferrule that includes one of the second plurality of cooling air openings extending therethrough at a first compound angle and at least one of the second plurality of cooling air openings extending therethrough at a second compound angle that is different than the first compound angle.

8. An igniter tube assembly for a gas turbine engine, the gas turbine engine including a combustor, and at least one igniter inserted at least partially into the combustor, said igniter tube assembly comprising:

an axis of symmetry extending therethrough;

an igniter tube comprising a first opening extending coaxially therethrough having a diameter sized to receive a portion of the igniter therethrough such that said igniter tube circumscribes the igniter and such that a gap is defined between said igniter tube and the igniter;

a ferrule coupled to said igniter tube, said ferrule comprising a radially inner surface and a radially outer surface; and at least one of a first plurality of cooling air openings defined substantially by and extending through said igniter tube and a second plurality of cooling air openings axially spaced from the at least one of a first plurality of cooling air openings which are defined substantially by and extending through said ferrule to facilitate channeling cooling air into said gap, wherein at least one of said second plurality of cooling air openings extends through said ferrule from said radially inner surface to said radially outer surface.

9. An igniter tube assembly in accordance with claim 8 wherein at least one of said first plurality of openings extends through said igniter tube at a first angle and at least one of said first plurality of openings extends through said igniter tube at a second angle that is different than said first angle.

10. An igniter tube assembly in accordance with claim 8 wherein at least one of said first plurality of openings extends through said igniter tube at a first compound angle and at least one of said first plurality of openings extends through said igniter tube at a second compound angle that is different than said first compound angle.

11. An igniter tube assembly in accordance with claim 8 wherein at least one of said second plurality of openings extends through said ferrule at a first angle and at least one of said second plurality of openings extends through said ferrule at a second angle that is different than said first angle.

12. An igniter tube assembly in accordance with claim 8 wherein at least one of said second plurality of openings extends through said ferrule at a first compound angle and at least one of said second plurality of openings extends through said ferrule at a second compound angle that is different than said first compound angle.

13. An igniter tube assembly in accordance with claim 8 further comprising a retainer that is sized to seat circumferentially against said igniter tube to secure said igniter tube and said ferrule to the combustor.

14. An igniter tube assembly in accordance with claim 13 wherein said retainer comprises a plurality of tabs that are coupled to the combustor to secure said igniter tube and said ferrule to the combustor.

15. A gas turbine engine including a combustor comprising an annular outer liner and an annular inner liner that define a combustion chamber therebetween, and at least one igniter tube assembly coupled to said combustor, and an igniter tube assembly comprising:

an axis of symmetry extending therethrough;

an igniter tube comprising a first opening extending coaxially therethrough having a diameter sized to receive a portion of the igniter therethrough such that said igniter tube circumscribes the igniter and such that a gap is defined between said igniter tube and the igniter;

a ferrule coupled to said igniter tube, said ferrule comprising a radially inner surface and a radially outer surface; and at least one of a first plurality of cooling air openings defined substantially by and extending through said igniter tube and a second plurality of cooling air openings axially spaced from the at least one of a first plurality of cooling air openings which are defined substantially by and extending through said ferrule to facilitate channeling cooling air into said gap, wherein at least one of said second plurality of cooling air openings extends through said ferrule from said radially inner surface to said radially outer surface.

16. A gas turbine engine in accordance with claim 15 wherein at least one of said first plurality of openings extends through said igniter tube at a first angle and at least one of said first plurality of openings extends through said igniter tube at a second angle that is different than said first angle.

17. A gas turbine engine in accordance with claim 15 wherein at least one of said first plurality of openings extends through said igniter tube at a first compound angle and at least one of said first plurality of openings extends through said igniter tube at a second compound angle that is different than said first compound angle.

18. A gas turbine engine in accordance with claim 15 wherein at least one of said second plurality of openings extends through said ferrule at a first angle and at least one of said second plurality of openings extends through said ferrule at a second angle that is different than said first angle.

19. A gas turbine engine in accordance with claim 15 wherein at least one of said second plurality of openings extends through said ferrule at a first compound angle and at least one of said second plurality of openings extends through said ferrule at a second compound angle that is different than said first compound angle.

20. A gas turbine engine in accordance with claim 15 further comprising:

a retainer that is sized to seat circumferentially against said igniter tube, said retainer comprising a plurality of tabs to secure said igniter tube and said ferrule to said combustor.

* * * * *